US012221911B1

(12) United States Patent
Blake et al.

(10) Patent No.: US 12,221,911 B1
(45) Date of Patent: Feb. 11, 2025

(54) SYSTEM AND METHOD FOR DETERMINING POSITION OF AXIAL CAM SHIFTING SYSTEM

(71) Applicant: FCA US LLC, Auburn Hills, MI (US)

(72) Inventors: Tyler Blake, Farmington Hills, MI (US); David R Pedro, Tecumseh (CA); Joseph Falcon, Saline, MI (US); Kurt E Roguse, Lake Orion, MI (US); Bindal Patel, Canton, MI (US); Gary Michael Chad Starnes, Lake Orion, MI (US); Nicholas Firsich, Clarkston, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 18/422,338

(22) Filed: Jan. 25, 2024

(51) Int. Cl.
*F01L 31/14* (2006.01)
*F01L 1/18* (2006.01)
*F01L 1/047* (2006.01)

(52) U.S. Cl.
CPC ..... *F01L 31/14* (2013.01); *F01L 1/18* (2013.01); *F01L 2001/0473* (2013.01); *F01L 2201/00* (2013.01); *F01L 2820/041* (2013.01)

(58) Field of Classification Search
CPC ... F01L 31/14; F01L 1/18; F01L 1/047; F01L 2001/0471; F01L 2001/0473; F01L 2201/00; F01L 2820/041; F01L 13/0015; F01L 13/0026; F01L 13/0036; F01L 13/0042; F01L 2013/0052
See application file for complete search history.

(56) References Cited

U.S. PATENT DOCUMENTS

2021/0071549 A1* 3/2021 Ciola ..... F01L 1/053

* cited by examiner

*Primary Examiner* — Loren C Edwards
(74) *Attorney, Agent, or Firm* — Jeremy J. Klobucar

(57) ABSTRACT

An axial cam shifting system configured to selectively open and close engine valves includes an axial cam shifting assembly and a controller. The axial cam shifting assembly includes a camshaft, a first cam assembly, an actuator, a carriage and a position sensor. The first cam assembly is received on the camshaft and has two distinct cam profiles. The actuator has a first pin and a second pin. The carriage is arranged on the camshaft and defines a track that selectively receives the first and second pins, wherein the axial shifting cam assembly is movable between a first, and a second position corresponding to alignment of the respective two distinct cam profiles. The position sensor communicates a signal indicative of a position of the carriage. The controller receives the signal and determines whether the carriage is in one of the first and second positions based on the signal.

14 Claims, 6 Drawing Sheets

SYSTEM AND METHOD FOR DETERMINING POSITION OF AXIAL CAM SHIFTING SYSTEM

FIELD

The present disclosure relates generally to an axial cam shifting system and, more particularly, to a control system and method for determining a position of an axial cam shifting system.

BACKGROUND

Combustion cycles on four-stroke internal combustion engines can be modified to achieve various desired results such as improved fuel economy. In one method, the expansion stroke is increased relative to the compression stroke. The effect is sometimes referred to as a Miller Cycle or as an Atkinson Cycle. The Miller and Atkinson Cycles can be achieved by either closing the intake valve earlier than a normal or Otto Cycle ("Base") with a shorter than normal intake valve lift duration ("EIVC"), or by closing the intake valve later by a longer than normal intake valve lift profile ("LIVC").

Recent automotive and truck industry trends have placed increased importance on the reduction of fuel consumption and emissions of the internal combustion engine. One method of reducing fuel consumption is to optimize air intake and exhaust into the cylinders through incorporation of discrete valve profiles. Various systems have been developed for altering the valve-lift characteristics for internal combustion engines. Such systems, commonly known as variable valve timing (VVT) or variable valve actuation (VVA), improve fuel economy, reduce emissions and improve drive comfort over a range of speeds.

Some current axial cam shifting systems provide two discrete positions and thus two discrete valve lift profiles offering two valve lift functions. A two position system allows a simple actuation system that needs to translate the axial shifting components to either a first or a second position. An actuator can be used to shift between the first and second positions. In some implementations it can be difficult to determine whether the cam shifting system is in the first position or the second position. Accordingly, there remains a need for improvement in the relevant art to properly identify the position of a shifting camshaft.

SUMMARY

According to one example aspect of the invention, an axial cam shifting system configured to selectively open and close engine valves associated with a valvetrain assembly includes an axial cam shifting assembly and a controller. The axial cam shifting assembly includes a camshaft, a first cam assembly, an actuator, a carriage and a position sensor. The first cam assembly is received on the camshaft and having two distinct cam profiles including a first cam profile, and a second cam profile. The actuator has a first pin and a second pin. The carriage is arranged on the camshaft and defines a track that selectively receives the first and second pins, wherein the axial shifting cam assembly is movable between a first, and a second position corresponding to alignment of the respective two distinct cam profiles. The position sensor communicates a signal indicative of a position of the carriage. The controller receives the signal over a predetermined time representative of a crankshaft angle and determines whether the carriage is in one of the first and second positions based on the signal.

According to other features, the controller is further configured to determine whether an edge of the track in the carriage has been detected; determine whether the edge is a rising edge; and determine whether the carriage is in one of the first or second position based on determining whether the edge is a rising edge.

According to additional features, wherein the controller is further configured to establish a detection window over the predetermined time; and determine a direction of the edge.

According to additional features, wherein the controller is further configured to set a fault code based on a determination that an edge of the track in the carriage has not been detected.

In other features, the sensor comprises a hall-effect sensor.

According to other features, the position sensor communicates a signal indicative of a detection of metal on the carriage.

According to additional features, the position sensor is mounted adjacent to the carriage.

According to additional features, the valvetrain assembly is a Type II valvetrain According to one example aspect of the invention, a method of detecting a position of an axial cam shifting assembly configured to selectively open and close engine valves associated with a valvetrain assembly is provided. The axial cam shifting assembly comprises a camshaft, a first cam assembly received on the camshaft and having two distinct cam profiles including a first cam profile, and a second cam profile, an actuator having a first pin and a second pin, a carriage arranged on the camshaft and defining a track that selectively receives the first and second pins, wherein the axial shifting cam assembly is movable between a first, and a second position corresponding to alignment of the respective two distinct cam profiles; and a position sensor that communicates a signal indicative of a position of the carriage. The method comprises receiving, at a controller, the signal over a predetermined time representative of a crankshaft angle; and determining, at the controller, whether the carriage is in one of the first and second positions based on the signal.

According to other features, the method further comprises: determining whether an edge of the track in the carriage has been detected; determining whether the edge is a riding edge; and determining whether the carriage is in one of the first or second position based on determining whether the edge is a rising edge.

According to additional features, the method further establishes a detection window over the predetermined time; and determines a direction of the edge within the detection window.

According to additional features, the method includes setting a fault code based on a determination that an edge of the track in the carriage has not been detected.

In other features, the sensor comprises a hall-effect sensor.

According to other features, the position sensor communicates a signal indicative of a detection of metal on the carriage.

According to additional features, the position sensor is mounted adjacent to the carriage.

According to additional features, the valvetrain assembly is a Type II valvetrain.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

As discussed above, current axial cam shifting systems provide two discrete positions and thus two discrete valve lift profiles offering two valve lift functions. A two position system allows a simple actuation system that needs to translate the axial shifting components to either a first or a second position. An actuator can be used to shift between the first and second positions. In some implementations it can be difficult to determine whether the cam shifting system is in the first position or the second position.

The present disclosure provides a system and method for determining a position of an axial cam shifting system. The system and method monitors a feedback signal of one or more hall-effect sensors in close proximity to the carriage of the axial cam shifting assembly. The control method monitors a detection window and determines a carriage position based on whether a first detected edge is rising or falling. When an actuator pin of the axial cam shifting assembly is ejected, meaning a transition between the first and second positions is in progress, a separate detection window is used to confirm the transition is completed.

Figure 1:
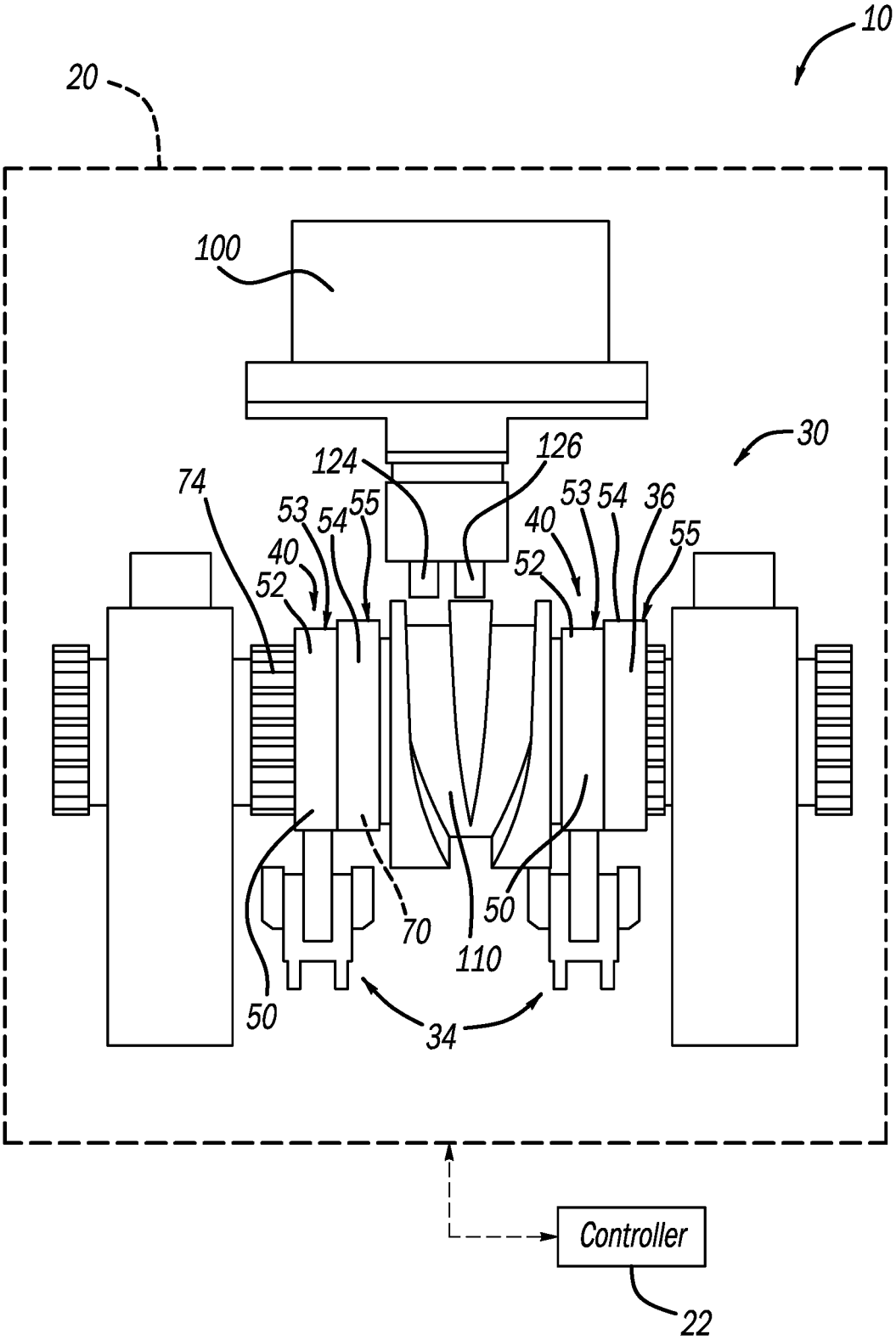
FIG. 1 is a perspective view of an axial cam shifting system constructed in accordance with one example of the present disclosure.
Figure 2:
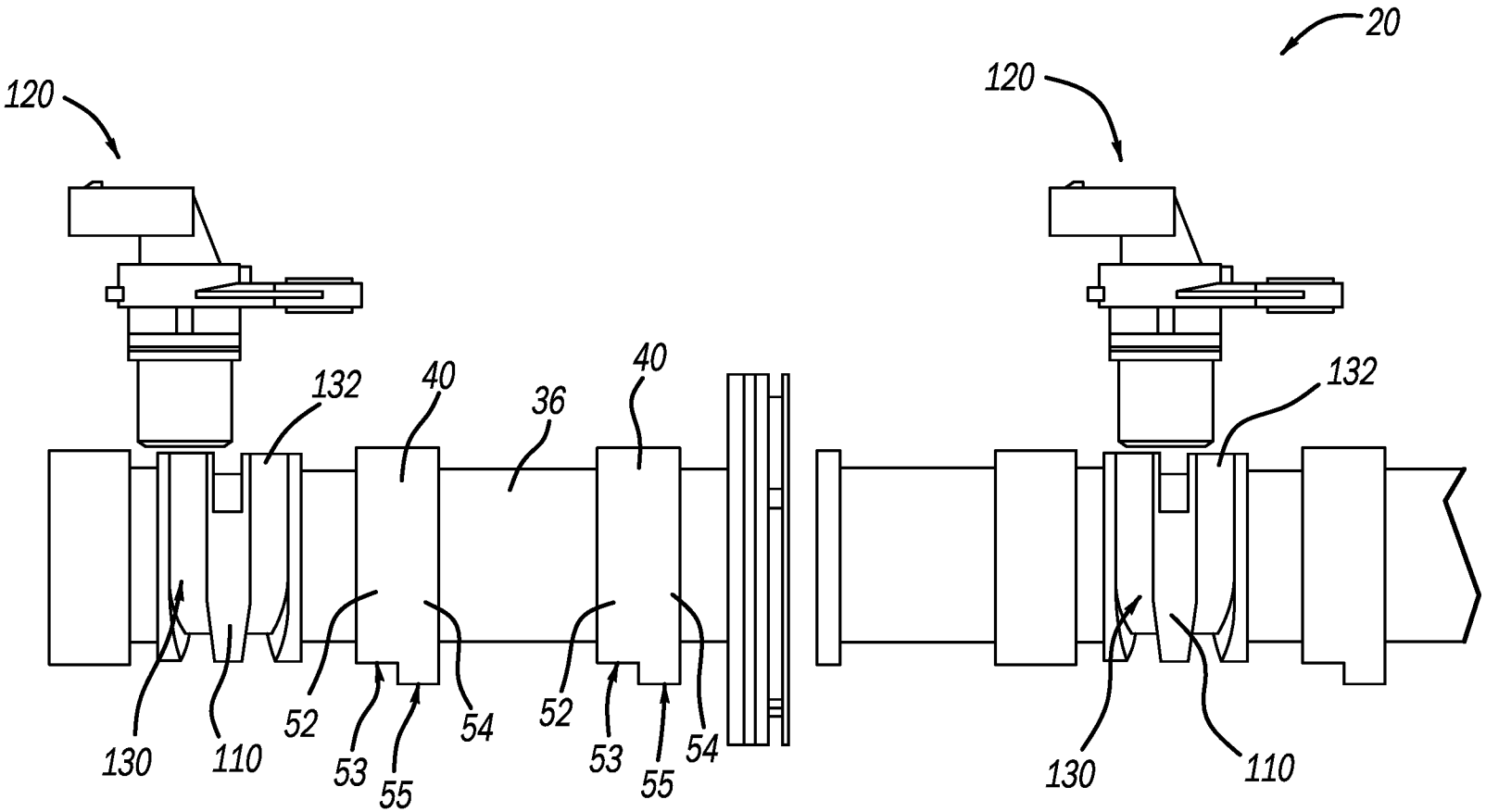
FIG. 2 is front view of a camshaft of the axial cam shifting system of FIG. 1 illustrating hall-effect sensors arranged at respective carriage Y-gates according to features of the present disclosure.

With initial reference to FIGS. 1 and 2, an axial cam shifting system constructed in accordance to examples of the present disclosure is shown and generally identified at reference numeral 10. The axial cam shifting system 10 includes an axial cam shifting assembly 20 and a controller 22. By way of example, the axial cam shifting assembly 20 can be configured for use with a Type II valve train assembly, partially shown at reference 30. The valve train assembly 30 can include a series of intake rocker arm valve assemblies 34 and a series of exhaust rocker arm valve assemblies (not specifically shown). An intake camshaft 36 can be operably associated with the intake rocker arm valve assemblies 34, and an exhaust camshaft (not specifically shown) can be operably associated with the exhaust rocker arm valve assemblies (not specifically shown). the camshaft 36 can rotate, for example, based on a rotatable input from a timing chain or belt linkage connected to a crankshaft of the engine (not shown).

The rocker arm assemblies 34 may include intake rocker arms 20 each configured for operation with a lobed intake cam assembly 40, and an engine cylinder valve (not shown) for an internal combustion engine cylinder (not shown). For simplicity, the following discussion is directed toward operation of the axial cam shifting system 10 with respect to the intake rocker arm valve assemblies 34. However, it will be appreciated that the axial cam shifting system 10 can be additionally or alternatively configured for controlling the exhaust rocker arm valve assemblies. The engine cylinder valves can more specifically include intake valves and exhaust valves. In the example provided the intake and exhaust valves are constructed similarly. In the example provided, the intake and exhaust cam assemblies and can be constructed similarly.

The intake cam assemblies 40 can be arranged on the intake camshaft 36 and are configured to selectively engage one of the intake rocker arm assemblies 34. The cam assemblies 40 can be configured for an axial cam shifting operation where the respective cam assembly 40 can be moved axially along the intake camshaft 36 between two discrete positions. As described herein, axial movement of the respective cam assemblies 40 can control the opening height and/or timing of the respective intake valves depending upon the axial position of the cam assembly 40.

Turning now to FIG. 1, each cam assembly 40 can include a body 50, a first cam 52 having a first lift profile 53, and a second cam 54 having a second lift profile 55. It is appreciated that the cam assembly 40 can be configured with additional cams within the scope of the present disclosure. The body 50 can be tubular and include in inner diameter or inner surface 70, which can be configured to receive the rotatable camshaft 36. For example, as illustrated in FIG. 1, the inner surface 70 may include a plurality of teeth (not shown) configured to meshingly engage teeth 74 formed on an outer surface 76 of the camshaft 16, 18.

Control of the intake valves 34 will be described. The first lift profile 53 is configured to engage the rocker arm valve 34 when the cam assembly 20 is in a first axial position, thereby achieving a first discrete valve lift event (e.g., a normal engine combustion mode, an engine brake mode, a deactivated cylinder mode, etc.). The second lift profile 55 is configured to engage the rocker arm valve 34 when the cam assembly 20 is in a second axial position, thereby achieving a second discrete valve lift event that can be distinct from the first valve lift event.

The axial cam shifting assembly 20 includes an actuator 100, a carriage 110 and a position sensor 120. The actuator includes pins 124, 126 that selectively deploy and retract. In the example provided, the pin 124 is used to switch from position one to position two and the pin 126 is used to switch from position two back to position one. The carriage 110 defines a Y-gate 130. The Y-gate 130 defines a track 132 that the respective pins 124, 126 ride along. During operation, the carriage 110, and therefore the cams 52, 54, shift as the actuator 100 deploys (e.g., and inserts) a pin 124, 126 into the track 132 of the Y-gate 130 causing translation of the carriage 110 laterally. In this regard, the desired cam 52, 54 is aligned with the rocker arms 34 to achieve the desired cam cycle. The position sensor 120 is described herein as a hall-effect sensor. It is contemplated that other sensors may be used within the scope of the present disclosure.

Figure 3:
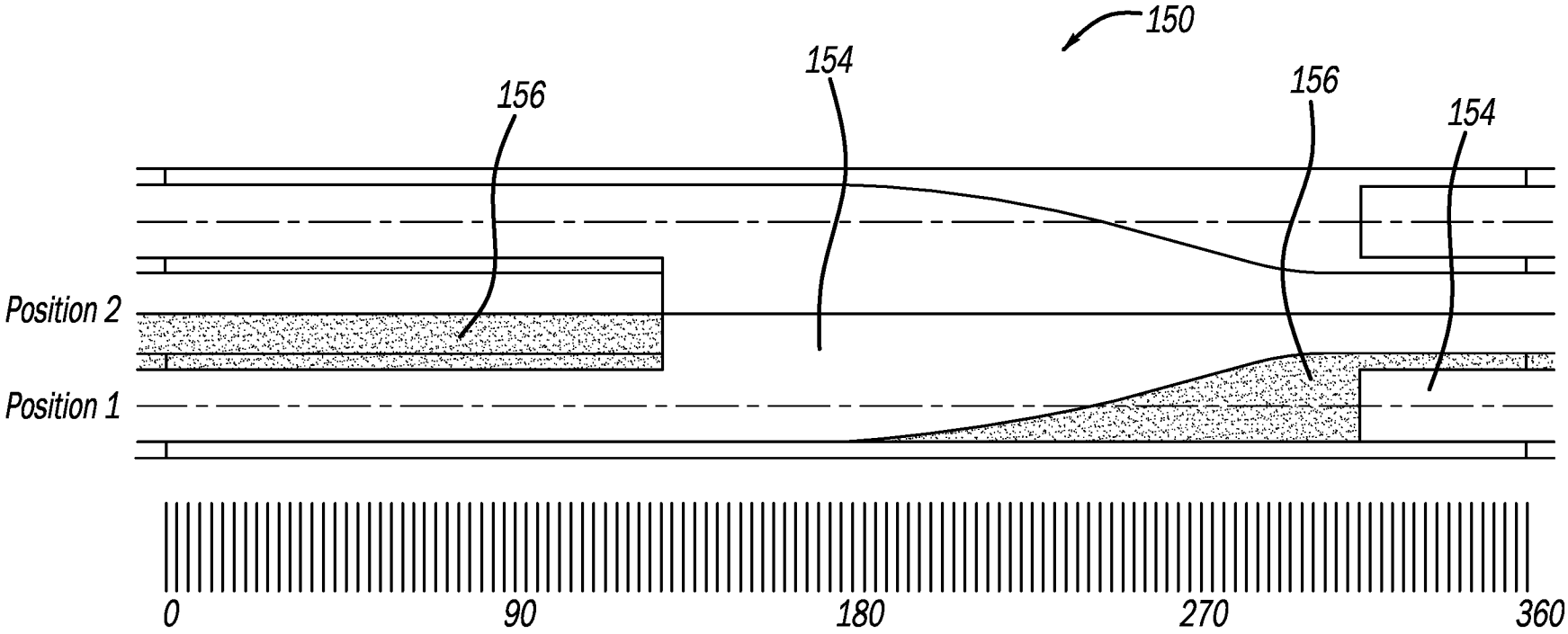
FIG. 3 is an exemplary trace that illustrates the position of the rising and falling edges sensed by the hall-effect sensor dependent upon the position of the carriage according to features of the present disclosure.

With additional reference to FIG. 3, an exemplary trace 150 that illustrates the position of the rising and falling edges sensed by the hall-effect sensor 120 dependent upon the position of the carriage 110 according to features of the present disclosure is shown. The trace 150 is shown through 360 degrees of camshaft rotation and represents a first signal 154 generally representing no metal detected at the Y-gate 130, and a second signal 156 representing metal detected at the Y-gate 130.

Figure 4:
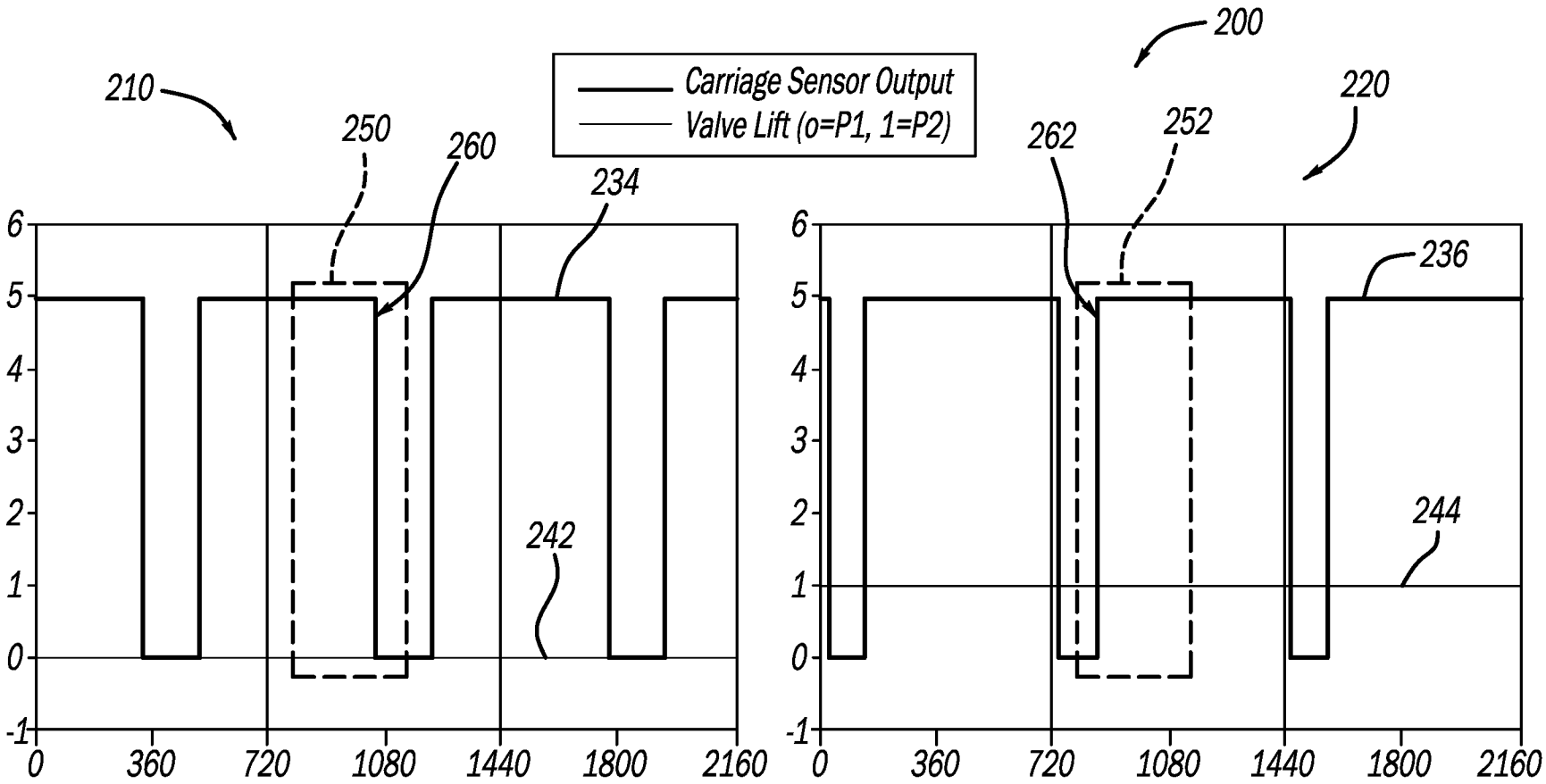
FIG. 4 is an exemplary trace that illustrates a feedback profile for the carriage at the first position and at the second position according to features of the present disclosure.

Turning now to FIG. 4, an exemplary trace 200 is shown that illustrates a feedback profile 210 for the carriage 110 at the first position and a feedback profile 220 for the carriage 110 at the second position according to features of the present disclosure. The feedback profile 210 shows a carriage sensor output 234 and a valve lift 242 for the first position. The feedback profile 220 shows a carriage sensor output 236 and a valve lift 244 for the second position. A first detection window 250 is shown at the first feedback profile 210 where control is awaiting for an edge 260 to be detected. A second detection window 252 is shown at the second feedback profile 220 where control is awaiting for an edge 262 to be detected. The direction of the edge detected in the window 250, 252 determines the position the carriage 110 is in. While windows 250, 252 are shown separate, the windows 250, 252 can be the same as the controller 22 does not know which position the carriage 110 is in.

Figure 5:
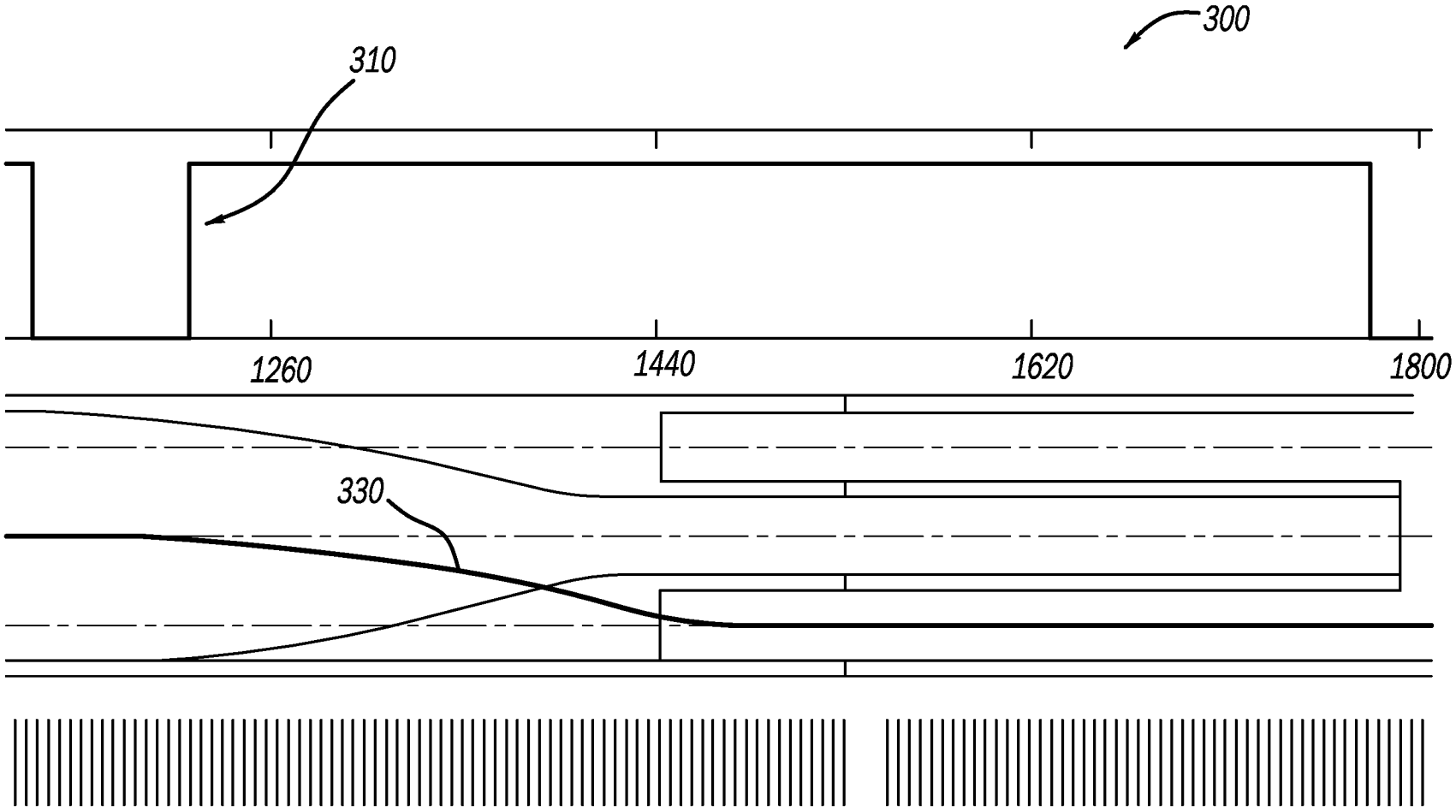
FIG. 5 is an exemplary trace that illustrates a sensor path that transitions corresponding to a shift between the first and second positions of the carriage.

With reference now to FIG. 5, an exemplary trace 300 is shown that illustrates feedback profile 310 for the carriage 110 during a shift transition between the first and second positions. A path of the carriage 110, or track 132 of the Y-gate the sensor 120 observes is represented by the carriage trace 330. During a transition between the first and second positions, the sensor 120 will observe slightly different square wave profiles. However, since the transition is a result of the actuator pin 124, 126 interacting with the Y-gate 130, the profile is known relative to the cam position. A flag in the control software indicates when a switch is requested from the actuator control, in which case a separate detection window can be used to confirm the transition.

Figure 6:
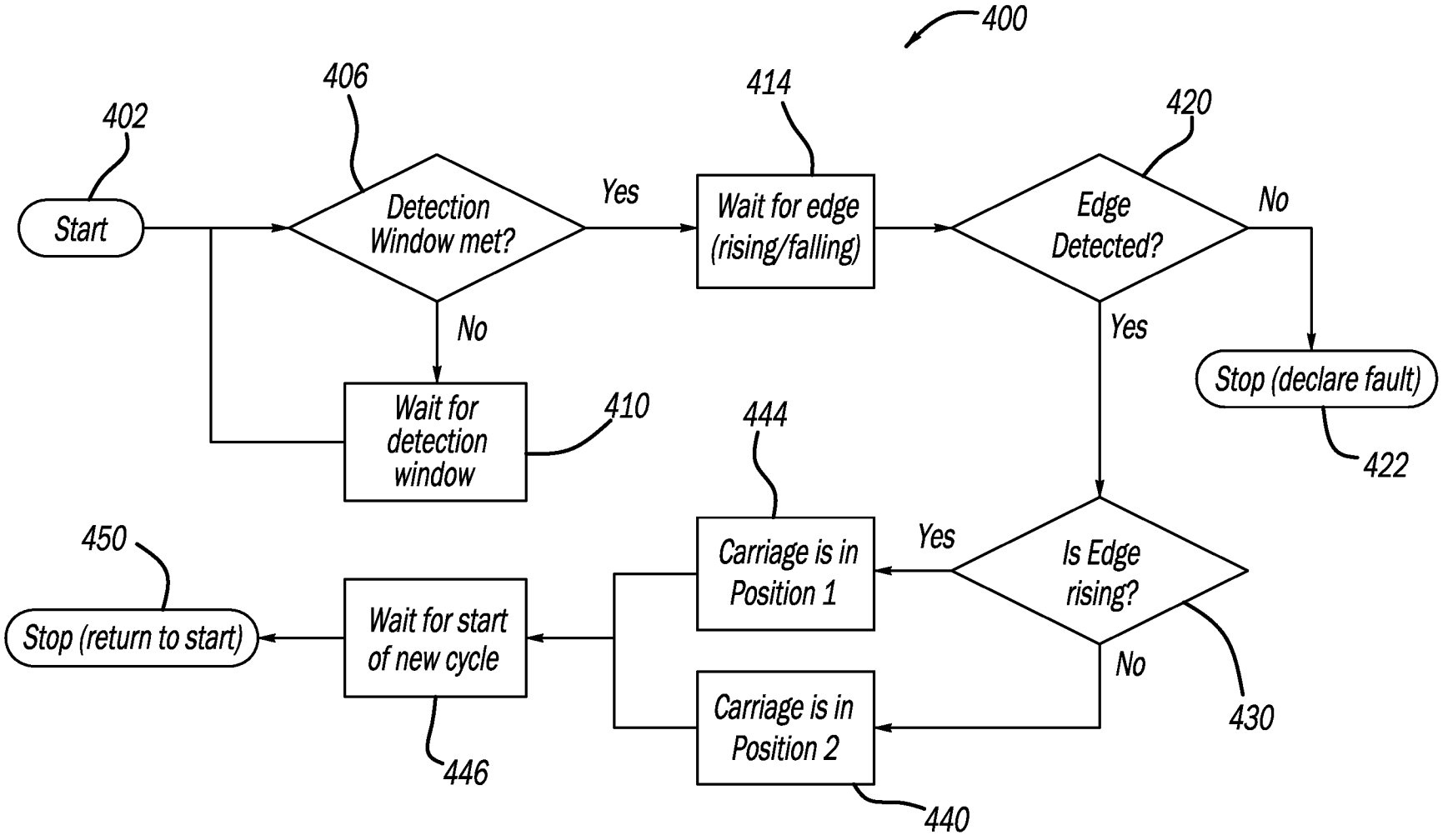
FIG. 6 is a logic flow diagram of an exemplary method for determining a position of an axial cam shifting system of FIG. 1 according to the present disclosure.

Turning now to FIG. 6, a method for determining the position of an axial cam shifting system 10 of FIG. 1 according to the present disclosure is shown and generally identified at reference numeral 400. The method starts at 402. At 406 control determines whether a detection window has been met. If the detection window has not been met, control waits for a detection window at 410 and loops the 406. If control determines that the detection window has been met at 406, control waits for a rising or falling edge (e.g., 260, 262, FIG. 4) at 414. At 420 control determines whether an edge 260 or 262 has been detected. If an edge has not been detected, control stops at 422. In examples, a fault code can be set. If control determines that an edge has been detected at 420, control determines whether the edge is a rising edge at 430. If the edge is not a rising edge, control determines that the carriage 130 is in the second position. If control determines that the edge is a rising edge, control determines that the carriage 130 is in the first position at 444. Control waits to start a new cycle at 446 and stops at 450.

The axial cam shifting system 10 and related method 400 provide advantages over prior art methods. In particular, the axial cam shifting system 10 is a direct measurement instead of an inferred position based on manifold pressure. Further, other prior art methods, such as trigger wheel based position methods, require dedicated hardware for monitoring purposes. The instant disclosure makes determinations based on monitoring the carriage 110 (e.g., the track 132 of the Y-gate 130) during a shift between the first and second positions.

It will be appreciated that the term "controller" as used herein refers to any suitable control device(s) that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture. It should also be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An axial cam shifting system configured to selectively open and close engine valves associated with a valvetrain assembly, the axial cam shifting system comprising:

an axial cam shifting assembly comprising:

a camshaft;

a first cam assembly received on the camshaft and having two distinct cam profiles including a first cam profile, and a second cam profile;

an actuator having a first pin and a second pin;

a carriage arranged on the camshaft and defining a track that selectively receives the first pin and the second pin, wherein the axial cam shifting assembly is movable between a first position, and a second position corresponding to alignment of the respective two distinct cam profiles; and a position sensor that communicates a signal indicative of a position of the carriage; and a controller configured to:

receive the signal over a predetermined time representative of a crankshaft angle;

determine, based on the signal, whether an edge of the track in the carriage has been detected;

determine whether the edge is a rising edge; and determine whether the carriage is in one of the first position or the second position based on determining whether the edge is a rising edge.

2. The axial cam shifting system of claim 1, wherein the controller is further configured to:

establish a detection window over the predetermined time; and determine a direction of the edge within the detection window.

3. The axial cam shifting system of claim 1, wherein the controller is further configured to:

set a fault code based on a determination that the edge of the track in the carriage has not been detected.

4. The axial cam shifting system of claim 1, wherein the sensor comprises a hall-effect sensor.

5. The axial cam shifting system of claim 1, wherein the sensor communicates a signal indicative of a detection of metal on the carriage.

6. The axial cam shifting system of claim 1, wherein the sensor is mounted adjacent to the carriage.

7. The axial cam shifting system of claim 1, wherein the valvetrain assembly is a Type II valvetrain.

8. A method of detecting a position of an axial cam shifting assembly configured to selectively open and close engine valves associated with a valvetrain assembly, the axial cam shifting assembly comprising a camshaft, a first cam assembly received on the camshaft and having two distinct cam profiles including a first cam profile, and a second cam profile, an actuator having a first pin and a second pin, a carriage arranged on the camshaft and defining a track that selectively receives the first pin and the second pin, wherein the axial cam shifting assembly is movable between a first position, and a second position corresponding to alignment of the respective two distinct cam profiles; and a position sensor that communicates a signal indicative of a position of the carriage, the method comprising:

receiving, at a controller, the signal over a predetermined time representative of a crankshaft angle;

determining, at the controller, whether an edge of the track in the carriage has been detected;

determining, at the controller, whether the edge is a rising edge;

determining, at the controller, whether the carriage is in one of the first position or the second position based on determining whether the edge is a rising edge.

9. The method of claim 8, further comprising:

establishing, at the controller, a detection window over the predetermined time; and determining, at the controller, a direction of the edge within the detection window.

10. The method of claim 9, further comprising:

setting, at the controller, a fault code based on a determination that the edge of the track in the carriage has not been detected.

11. The method of claim 8, wherein the sensor comprises a hall-effect sensor.

12. The method of claim 8, wherein the position sensor communicates a signal indicative of a detection of metal on the carriage.

13. The method of claim 8, wherein the position sensor is mounted adjacent to the carriage.

14. The method of claim 8, wherein the valvetrain assembly is a Type II valvetrain.

* * * * *